US006010764A

United States Patent [19]

Abrams

[11] Patent Number: 6,010,764

[45] Date of Patent: Jan. 4, 2000

[54] TRANSFER FABRICATED FROM NON-COMPATIBLE COMPONENTS

[75] Inventor: Louis B. Abrams, Fort Collins, Colo.

[73] Assignee: High Voltage Graphics, Inc., Fort Collins, Colo.

[21] Appl. No.: 09/050,089

[22] Filed: Mar. 28, 1998

[51] Int. Cl.[7] ..... B05D 1/14

[52] U.S. Cl. ..... 428/90; 428/94; 428/914

[58] Field of Search ..... 428/90, 94, 914

[56] References Cited

U.S. PATENT DOCUMENTS

| | | | |
|---|---|---|---|
| 4,035,532 | 7/1977 | Gregorian et al. | 428/90 |
| 4,102,562 | 7/1978 | Harper et al. | 359/518 |
| 4,142,929 | 3/1979 | Otomine et al. | 156/72 |
| 4,201,810 | 5/1980 | Higashiguchi . | |
| 4,292,100 | 9/1981 | Higashiguchi | 428/90 |
| 4,396,662 | 8/1983 | Higashiguchi | 428/90 |
| 4,652,478 | 3/1987 | Mau | 428/43 |
| 4,687,527 | 8/1987 | Higashiguchi | 428/90 |
| 4,741,791 | 5/1988 | Howard et al. | 156/72 |
| 4,810,549 | 3/1989 | Abrams et al. | 428/88 |
| 4,980,216 | 12/1990 | Rompp | 428/90 |
| 5,047,103 | 9/1991 | Abrams et al. | 156/72 |
| 5,207,851 | 5/1993 | Abrams . | |
| 5,346,746 | 9/1994 | Abrams | 428/195 |
| 5,350,474 | 9/1994 | Yamane | 156/240 |
| 5,489,359 | 2/1996 | Yamane | 156/540 |
| 5,622,587 | 4/1997 | Barthelman | 156/251 |
| 5,766,397 | 6/1998 | Jones | 156/230 |
| 5,858,156 | 1/1999 | Abrams et al. | 156/230 |
| 5,912,065 | 6/1999 | Kukoff | 428/195 |

*Primary Examiner*—Blaine Copenheaver
*Assistant Examiner*—Arti Singh
*Attorney, Agent, or Firm*—Paul M. Denk

[57] ABSTRACT

A transfer comprising a flocking and non-compatible appliqué, the transfer to be applied to a material in a single application, the transfer being comprised of a release sheet to which flocking is applied in a desired pattern; an appliqué being cut to a desired pattern to fit with the pattern of said flocking, said appliqué being adhered to said release sheet; and a transfer adhesive applied over said appliqué and said flocking, said transfer adhesive being the type that adheres the transfer to a desired material.

9 Claims, 2 Drawing Sheets

TRANSFER FABRICATED FROM NON-COMPATIBLE COMPONENTS

CROSS-REFERENCE TO RELATED APPLICATION

This application is a non-provisional patent application based upon a provisional patent application having Ser. No. 60/041,935, FILED ON Apr. 4, 1997.

BACKGROUND OF THE INVENTION

This invention relates to a heat applied appliqué or plush transfer which may be applied to clothing, such as T-shirts, sweatshirts, or other clothing, or other materials, and, in particular, to a transfer having certain component(s) that may be made of material which is not essentially compatible with the associated plush flocking material that constitutes a major portion of the transfer.

Heat applied or iron-on type transfers generally have a flocking in the form of a desired design which is secured to a backing. The flocked design has a hot melt glue applied thereto, to adhere the transfer to a piece of clothing. Some transfers include appliqués or inserts made of material other than flocking. A reflective material, such as is available from 3-M Company, of Minneapolis, Minn., is one example of such material. This material does not readily adhere to the adhesive and backing, or even to the surrounding or associated flocking, and thus must be secured to the transfer or adhered to the piece of clothing in a secondary operation. The latter choice is not desirable, it entails additional time and effort, and it is very difficult to obtain proper alignment of the various transfer components, or any insert of non-compatible component used in association therewith, when the transfer is applied to such type of clothing.

The concept of applying a plush textured transfer to clothing, and its initial construction and assembly, is readily disclosed in my prior patents of which I was a coinventor, including U.S. Pat. No. 5,047,103, relating to a method for making flock appliqué and transfers. Furthermore, U.S. Pat. No. 4,810,549, shows another form of plush textured multicolored flock transfer. In these particular embodiments, as shown in the prior art, the transfers are made integrally, wherein the assembled appliqué is formed completely of flocking materials, whether it be single color, or multicolored flock transfers, and do not include any non-compatible type components therein, and their associated problems, in their construction.

BRIEF SUMMARY OF THE INVETION

The principal object of the current invention is to produce a plush transfer and appliqué which is made of non-compatible materials, such as having an insert formed of reflective type material, which may be fabricated from components that exhibit a very low coefficient of friction, and therefore, are difficult to provide for adherence of adhesives, or other tacky materials, that may locate the insert in conjunction with the surrounding or associated plush flock transfer, in its assembly.

Briefly stated, in summary, this invention contemplates a transfer which is securable to clothing, or other items, and includes a flocking layer formed in a precise and desired pattern, and an insert formed in an equally desired pattern with each of the patterned materials providing and exhibiting a particular image, in their combined assembly, when formed into a transfer, and applied to clothing, or the like. In combination, the flocking and insert are formed to create a desired design. The insert is secured in association with the flocking, so that the flocking and insert may be applied to an item of clothing in a single application step. The application of the transfer, once assembled, is dictated by the assembly and fabrication of the transfer itself. In its manufacture, the fabrication of the transfer commences with the application of flocking material to a release sheet, in the general pattern desired for the flock to be applied to an item of clothing, etc. The flock is applied to the release or base sheet, generally in a manner as previously described in the previous U.S. Pat. No. 5,047,103, and U.S. Pat. No. 4,810,549. The flocked material may have various voids, that form the particular designs in which the transfer desired to have applied thereto the so called non-compatible component, in the finished product.

Essentially, these non-compatible type components, as previously referred to, may include a glass bead coated reflective material, such as fabricated by 3-M Company, as is known in the trade, or other material such as polyester film, shiny aluminum, or other metal, or the like that may also be vapor coated with the glass beads.

In the next step for manufacture of the transfer of this invention, the 3-M type Scotch like brand material is cut to the design of the void in the flock of the transfer and to which the patterned and designed reflective material is to be reasonably precisely located, so as to add that aspect of functionality to the finished transfer, when applied to an item of clothing, and the like. The reflective material normally includes a release sheet, and to which a sheet of the reflective material is applied, usually this material includes a top or finished side which is coated with glass beads, or the like, and the bottom or unfinished side which is formed of a base material, to which any number of common adhesives or hot melts will adhere, and can be applied. To the release sheet side of the reflective material there is applied a pressure sensitive adhesive, also available from 3-M Company, and this pressure sensitive adhesive includes a paper backing, and a highly adhesive or tacky surface of material on its opposite side. That pressure sensitive adhesive is applied to the release sheet that is applied to the reflective surface of the noncompatible insert. Then, the non-compatible insert, as formed, is cut to the precise design desired to be applied to the previously flocked appliqué component and its base sheet.

In this condition, and stage of assembly, the now combined previously flocked material, formed upon its base sheet, has the previously cut and patterned non-compatible portion of the transfer applied thereto, by peeling off the carrier paper from the pressure sensitive adhesive, and adhering that component of the transfer to the previously flocked base sheet.

When assembled in this manner, the exposed portion of the flock, upon its base sheet, and the release sheet of the non-compatible component, will be exposed upwardly from its base sheet. To these two components, there is applied a screen print permanent latex fiber adhesive over the fibers to be transferred, and a coating of a hot melt powder, in the particular overall design of which the transfer is to be applied to clothing, the hot melt powdered coating is allowed to dry, is vacuum brushed and cured, in preparation for application of the transfer to an item of clothing.

In the final step, the transfer is applied to clothing, or other cloth material, heat is applied to it, whether it be by an iron-on process, or by other heat applicator and once applied, the heat transfer and insert are peeled off, leaving the applied patterned flock on the clothing, with the noncompatible insert formed of reflective material being exposed externally, as a rather unique form of appliqué that may be applied and permanently secured to an item of clothing, or other material.

Once formed, this style of appliqué may be transferred onto athletic shirts, such as a football shirt, basketball shirt, exhibiting a school name, the name of the player, the number of the player involved, the name of the college or professional team, such transfers being formed for disclosure of any of an infinite variety of patterns, as required, upon any type of supporting surface, and desired by the end user.

It is, therefore, the principal object of this invention to provide an iron-on or other heat applied transfer which may be applied to clothing, other cloth components, and the like.

Another object of this invention is to provide a transfer that can be applied to almost any surface.

Another object of this invention is to provide such a transfer which includes an insert.

Another object of this invention is to provide a transfer which may include as an insert a non-compatible type component.

A further object of this invention is to provide a transfer in which the insert is easily applied to the clothing at the same time, and simultaneously with, as the flocking portion of the transfer is applied to the clothing.

Still another object of this invention is to form a transfer that can be applied simultaneously to any item of clothing, or other cloth material, and not require the separate application of a non-compatible component of the transfer, under any subsequent procedure.

These and other objects will become more apparent to those skilled in the art in light of the following disclosure, and the accompanying drawings.

DESCRIPTION OF THE PREFERRED EMBODIMENT

Figure 1:
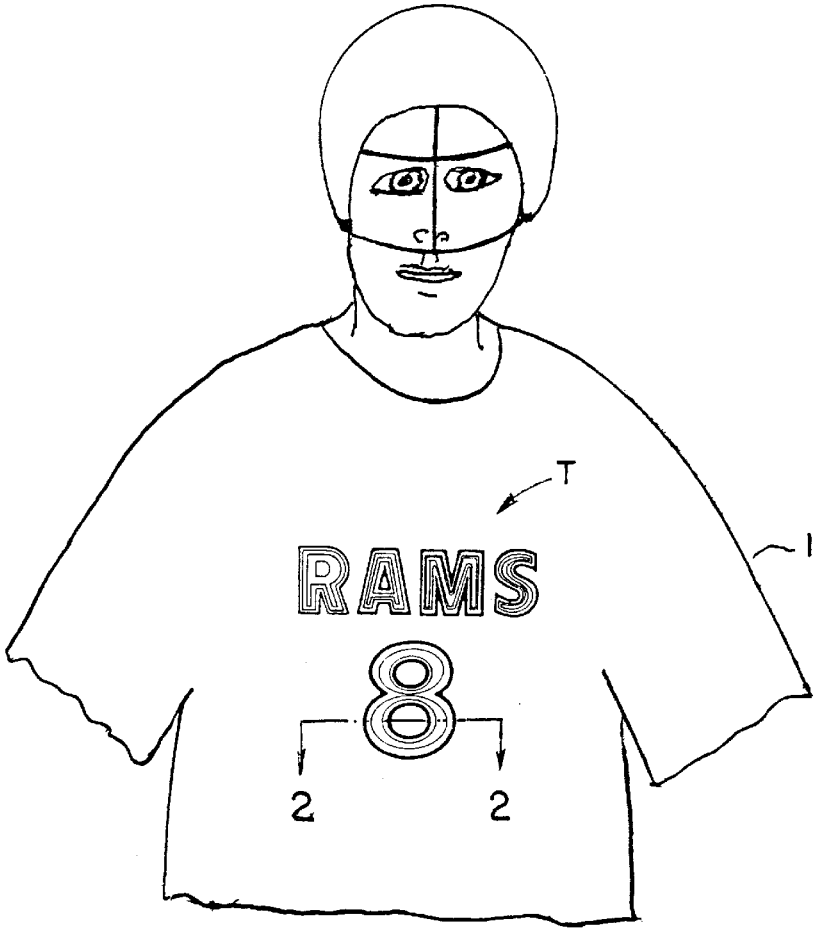
FIG. 1 is a view of a person, namely a football player, wearing a game shirt having the appliqué of the present invention applied thereto.

In referring to the drawings, and in particular FIG. 1, the transfer of this invention, as can be generally seen at the vicinity T has been previously applied to the shirt, such as the football shirt 1, as noted. As can be seen, the appliqué of this invention may include numbers, letters, names, such as the name "Rams", or the name of any other team, the college name, high school name, numerals, and the like, of the type that are normally applied to the game shirts, or other shirts, or even jackets, etc. Any type of transfer can be formed and applied for this purpose.

Figure 2:
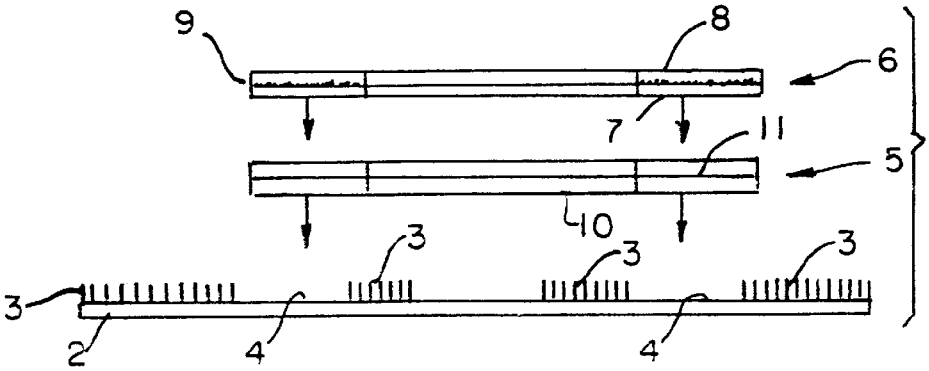
FIG. 2 is a sectional view taken through the number on the appliqué, along the line 2—2 of FIG. 1, with the appliqué being exploded to disclose its various components.

The appliqué of this invention includes a series of laminar layers, which are formed to provide the overall transfer, that is ready for shipment to the clothing manufacturer, to have the transfer applied directly to the clothing, in preparation for delivery to the teams, stores, and the like. As can be seen in FIG. 2, the flocked appliqué is generally formed with its base sheet 2, and has patterned flock material applied generally thereon, as at 3, in the manner as previously described in the two identified patents. The flocked material normally will have some designed spacing, as at 4, and this spacing is provided for accommodating the non-compatible component of the transfer, as previously explained, which in this particular instance, is designed to furnish a reflective type of material surface to the appliqué, when completed.

Two additional components of the transfer are shown at 5 and 6, and these layers may also be laminated into position, in the following manner. Initially, a beaded reflective material 8, such as a reflective type of material that may be coated with minuscule glass beads, and the like, is prepared. This type of material is readily available from 3-M Company, and is used to furnish a reflection in the event any light shines upon it, to give a more glaring appearance to the beaded surface, when observed. By definition, this is the type of material that is desired to be incorporated into the fiber coated heat seal transfer of this design, but because it has a surface, namely, the glass bead coated reflective surface, that is difficult or impossible to commonly use with hot melt adhesives, and the like, for adherence purposes, it is difficult to apply the reflective beaded material directly to the flock, or the flock thereto, and keep it in position, particularly after sustained and prolonged usage. Hence, the beaded reflective material 8, with its beaded surface 9 formed thereon, is prepared with the backing material 7, from any supplier, such as the 3-M Company, as previously explained. To the backing material 7 of the reflective material is applied the pressure sensitive adhesive component 5, and it comprises a paper cover 10, having the pressure sensitive adhesive 11, formed upon its upper surface, as can be noted. The pressure sensitive adhesive 11 is applied directly to the backing material 7, of the coated reflective material. After this is done, and such material may be formed in sheets, the particular and precise design desired for the reflective material, and having dimensions very similar if not identical to the spacing 4 provided upon the flocked base, once it is patterned cut precisely, or even only slightly overlaps the flocking 3, the paper cover 10 may be peeled away, exposing a highly tacky pressure sensitive adhesive coating 11, which by now is applied to the previously exposed side of the backing material 7, and this pressure sensitive adhesive is then inserted and secured directly onto the spacing 4, of the base 2, and firmly adhered in place. Once this is done, the transfer is generally prepared for subsequent usage, with one exception.

Figure 3:
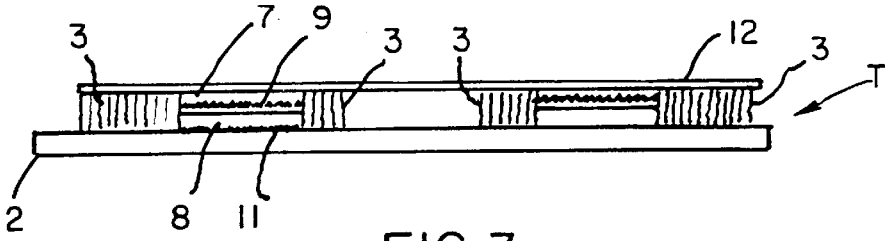
FIG. 3 is a view of the assembled appliqué of FIG. 2, and having a hot melt adhesive applied to its upper and the outer surface of the combined flock and reflective material.
Figure 4:
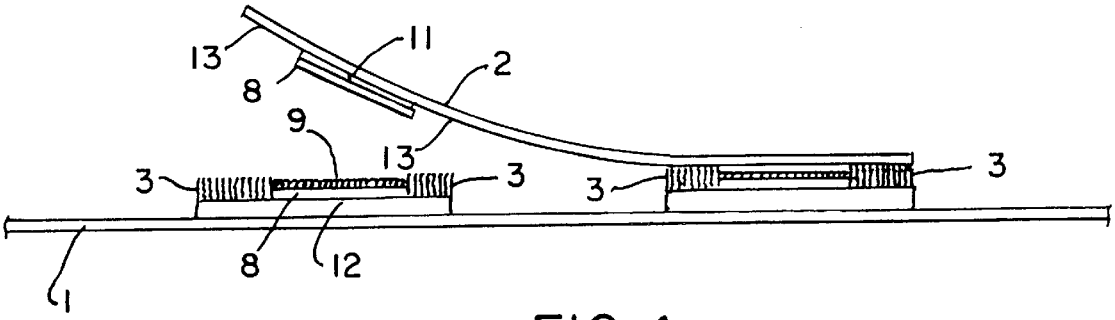
FIG. 4 is an inverted view of the appliqué of FIG. 3, after its inverting and heat application to the surface of the shown shirt, with parts of the appliqué being peeled away after its application to said shirt.
Figure 5:
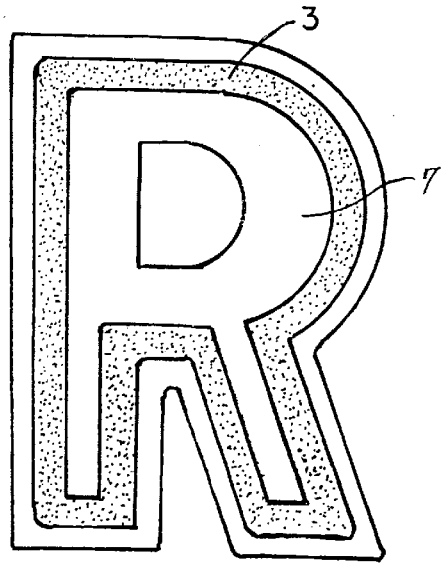
FIG. 5 shows an enlarged view of one of the letters formed of the transfer of this invention, as disclosed in FIG. 1.

As can be seen in FIG. 3, the transfer T is prepared, the base sheet 2, with the segments of flock 3 is prepared, and the backing for the beaded material, as at 7, is in place, having its beads 9 arranged intermediate its cover paper or sheet 8, and the pressure sensitive adhesive 11. When the components of the transfer are assembled or manufactured into this condition, the upper edges of the patterned and designed flock 3, in addition to the exposed surface of the backing material 7, is screen printed with the permanent latex fiber adhesive, which is coated with a hot melt powder, as along the surface 12. This coating is done in a delicate manner, so as not to dislodge the previously applied reflective material insert, comprising the combination of components 5 and 6, as previously explained. The coated hot melt powder is then dried, vacuum brushed, and cured, to prepare it for application to a shirt, or other cloth or related surface. In this condition, the entire transfer is assembled, and ready for usage. Then, the transfer may be applied to the surface of a shirt 1, or any other cloth or related surface, and it is subjected to heat, whether it be an iron, or other heat application, so as to soften the hot melt 12, and provide for its adherence to the surface of the shirt 1. The hot melt is very tenacious in its application, and when applied in this manner, as can be seen in FIG. 4, the hot melt readily adheres the reflective material 9, and the flock 3, to the surface of the shirt 1, and in addition, the backing material 8 of the reflective beaded surface 9 is also readily adhered to the shirt, and as can be seen, as the base sheet 2 is peeled away, it also peels some residue of the flock, as at 13, away from the applied transfer, and also, separates the white paper cover 7, in addition to the pressure sensitive adhesive 11, pulling these components free from the applied transfer, so that only the precisely patterned flock 3, and the reflective surface 9, remains permanently affixed to the surface of the shirt 1.

Obviously, the transfer components and method of application as described herein can be used with a variety of different types of flock formed types of transfers, or the system may be used for application of a glass bead or other materials coated reflective material when formed into a transfer, or appliqué, as explained herein, or for usage for related purposes. In addition, various of the liners, backing material, base material, as described in this application, in certain instances, being fabricated of paper, or the like, could obviously be made of other materials, such as one of the polymers, like polyethylene, etc., and be used in a similar manner for fabrication of the various components of the transfer described herein.

In addition, as previously described in the earlier patents to the inventor herein, as with the process described in the plush textured multicolored flock transfer, in the beginning of the process of its formation, the carrier film is coated with a release adhesive, then electrostatically coated with the multicolor fibers. This has been previously described in the earlier patents, and which form the base for the plush textured flock transfer, as used in this invention, but which is flocked into a more patterned design, for being combined with a more reflective, but non-compatible type material.

In addition, the insert area where the reflective material may be applied, once it is designed cut, deflocked or unblocked initially, could include various markings to help with the alignment of the insert, where ever it is being applied to the design, which will depend upon the letter involved, the number selected, or the design of the mascot, etc., under consideration.

If the appliqué is made with the appropriate materials, for example, vinyl reflective surface material as compared to metallic, vinyl and/or polyester hot melt, synthetic textile versus natural fiber, the heat sealing and die cutting may be done simultaneously, with one cutting sequence, using a high frequency heat source and a metal die. In the case of the preferred type of plush transfer, as explained previously, using a non-compatible insert material, that is difficult of adhering in place, during fabrication of the transfer, heat is normally applied to a base material, which is usually a textile, and then the entire transfer is die-cut out in the precise and desired shape, of the finished transfer desired to be secured to an item of clothing, or the like.

When the invention is made in the manner as described herein, it enables noncompatible inserts to be located inside a fiber coated heat sealed design, with a perfect butt registration of the fibers, with no unsightly or problematic overlap, and no gaps, whatsoever, in the finished design after being applied by heat to a textile surface. When the transfer is assembled in the manner as previously described, it temporarily and inexpensively holds together the insert, in its set position, until it can be manufactured into the final fiber coated heat seal appliqué, and made a permanent part of the final and assembled applied transfer. Obviously, combinations of different textures, incorporation of unique materials such as the reflective material whose surfaces make it impossible to insert them in conventional ways, yet with perfect registration, and in a practical and cost-effective way, is the end result of the transfer fabricated in the manner as described herein.

The transfer of this invention does not incorporate any insert material by overlapping the design around its various edges, to get some degree of registration, and this is an advantage with textile inserts which have unfinished edges, and that can come apart, as for example, during washing. For example, if part of the flock overlies the noncompatible material, then after a few washings, that peripheral or edge flock may deteriorate, or come free, and leave a very unsightly type of emblem, as applied to the jersey, etc. With many non-compatible materials, there are finished edges that do not need to be covered. And, a surface that does not adhere using commonly available thermoplastic hot melt adhesives, does not work, except when assembled in the manner as described herein, by using intermediate materials that function to cooperate with the non-compatible materials, and to provide for its registration and application with the previously applied flock components of the appliqué. Instead, this current method to temporarily locate a non-compatible insert material into the plush transfer, during its manufacturing process, in a stable and cost-effective manner, enables it to become a permanent part of the finished product.

Obviously, other types of non-compatible insert materials may include lenticular plastic, vinyl, glass, metal, rubber, holograms, and the like.

Obviously, the type of hot melt adhesive that is used in this invention, as commonly known in the art, generally is fabricated as a powdered binder, with a nylon polyester hot melt adhesive composition. It is applied, brushed and vacuumed, into a precise location, and is readily available for application of the flock, in this instance, the back side of the reflective material, directly to a shirt, or other item of clothing, or material, through the use of heat.

Other modifications particularly in the methods of incorporating the noncompatible inserts into the pre-designed flock material, as described herein, includes the cut butt-registering of pieces, heat laminating such pieces into the window of the flock, of the finished transfer, through the use of a hot melt adhesive, which may have already been pre-applied to the transfer, or through usage of a layer of overlapping hot melt material. Also, it is likely that the inserts may be placed onto the film carrier prior to printing the release adhesive, through the use of a jig, with visual guides or templates provided above for alignment, to provide for a permanent print of the adhesive at precise locations during the manufacture of the transfer. It may be likely that other materials may be blended or coated into the transfer, like polyurethane resin, into or onto the material in order for it to be able to be used like normal transfers, with the transfer hot melt adhering to the surface and therefore no longer maintaining the insert as an incompatible material, although it may yet contain some incompatible components, such as a layer of glass beads, and the like. In addition, applying the non-compatible inserts, cut to fit within the window of the fiber transfer, and onto the base material which is compatible with a hot melt, and which may overlap into the hot melt area, may be performed. This may be laminated onto the bottom of the transfer, and can also be used with colored compatible material applied to the base component, in order to hide any gaps, where overlapping of various components cannot be achieved. Another enhanced way that the method of this invention can be done, and especially for designs requiring multiple pieces of noncompatible inserts, which may include more intricate designs, is to apply another temporary carrier paper to the bottom side of the non-compatible insert, and kiss-cut the same from the top side and remove or segregate select pieces that are not desired for transfer to the fiber coated sheet, remove such liner from the pressure sensitive adhesive, and press/stick the insert pieces into place in register onto the fiber coated sheet, remove the paper liner from the top, and then screen print the flock as usual.

As a further alternative or embodiment, it appears that the concept of this invention can be accomplished by taking a segment of the non-compatible material, attach a pressure-sensitive or hot melt adhesive, stick it into the flocked transfer sheet, and then proceed with the remaining steps to secure it to a cloth or item of clothing. In certain instances, the reflective material, whether it be made reflective either through the use of beads, metal, or the like, may have a hot melt coating provided upon its top surface, as initially processed.

These are all examples of variations that can be done to achieve the finished transfer of this invention, and provide alternative steps for use in the method of its manufacture, as can be understood.

Variations or modifications to the subject matter of this invention may occur to those skilled in the art upon review of the disclosure herein. Such alternative components and procedures are considered to be within the spirit and scope of the invention as described herein. The description of the preferred embodiment as set forth herein is done so for illustrative purposes only.

I claim:

1. A transfer comprising a flocking and a non-compatible appliqué, the transfer being adapted to be applied to a material in a single application step; the transfer comprising:

a release sheet to which said flocking is applied in a desired pattern;

said appliqué being cut to a desired pattern to fit with the pattern of said flocking, said appliqué being adhered to said release sheet; and a transfer adhesive applied over said appliqué and said flocking, said transfer adhesive being of the type to adhere the transfer to a desired material.

2. The transfer of claim 1 wherein the appliqué is chosen from the group consisting essentially of a bead-coated reflective material, a polyester film, aluminum, vinyl, lenticular plastic, glass, rubber, and holograms.

3. The transfer of claim 1 wherein the appliqué includes a release sheet; an appliqué adhesive being applied to the release sheet to adhere the appliqué to the transfer release sheet.

4. The transfer of claim 1 further including a latex fiber adhesive applied to said appliqué; said transfer adhesive being applied to said latex fiber adhesive, said latex fiber adhesive and said transfer adhesive co-acting to adhere said appliqué to said transfer adhesive.

5. A method of producing a transfer comprising a flocking in a desired pattern and a non-compatible appliqué in a desired pattern, the flocking and appliqué being adapted to be applied to a material in a single step; the method comprising:

applying said flocking to a release sheet in a desired flocking pattern;

providing said appliqué in said desired pattern;

adhering said appliqué to said release sheet;

applying a first adhesive over said appliqué, said first adhesive being of a type to adhere to the appliqué; and applying a hot-melt adhesive over said flocking and said first adhesive; said first adhesive being compatible with said hot-melt adhesive, to adhere said appliqué to said hot-melt adhesive.

6. The method of claim 5 wherein said appliqué has a release backing, said step of adhering said appliqué to said release sheet including applying a pressure sensitive adhesive to the appliqué release backing.

7. The method of claim 6 wherein said pressure sensitive adhesive is provided as a sheet having a release sheet; said sheet having an adhesive side and a backing side; said method including adhering the adhesive side of said sheet to aid appliqué release sheet and removing said pressure sensitive adhesive sheet release sheet to adhere said appliqué to said transfer release sheet.

8. The method of claim 5 wherein said appliqué is cut to its desired pattern after said pressure sensitive adhesive is applied to said appliqué release sheet.

9. The method of claim 5 wherein said first adhesive is a latex fiber adhesive.

* * * * *